United States Patent [19]

Treanor

[11] 4,049,152

[45] Sept. 20, 1977

[54] CLOSURE CAPS FOR VESSELS

[75] Inventor: Eugene Joseph Treanor, Burnham-on-Sea, England

[73] Assignee: Makap Limited, London, England

[21] Appl. No.: 647,933

[22] Filed: Jan. 9, 1976

[51] Int. Cl.[2] ..... B65D 51/16

[52] U.S. Cl. ..... 220/209; 220/206; 220/203; 220/295; 220/367

[58] Field of Search ..... 220/306, 203, 208, 209, 220/360, 361, 367, 368, DIG. 27, 206, 295,

[56] References Cited

U.S. PATENT DOCUMENTS

| | | | |
|---|---|---|---|
| 2,990,971 | 7/1961 | Enell | 220/203 |
| 3,086,677 | 4/1963 | Konchan | 220/203 |
| 3,164,288 | 1/1965 | Boomgaard | 220/203 |
| 3,189,213 | 6/1965 | Nimmo | 220/295 X |
| 3,578,467 | 5/1971 | Huber | 220/209 X |

*Primary Examiner*—William I. Price
*Assistant Examiner*—Steven M. Pollard
*Attorney, Agent, or Firm*—Scrivener, Parker, Scrivener & Clarke

[57] ABSTRACT

A closure cap is provided for an opening in a vessel. Inner and outer seatings extend around the opening. The closure cap has a body with attachment means to enable the cap to be releasably secured in the opening, and the body also has an inner seal for engaging the inner seating and an outer seal for engaging the outer seating. The cap is characterized by the fact that at least one of those seals comprises an outwardly directed flange of a flexible and resilient plastics material supported at its inner edge and yielding resiliently when in use. The flange is urged towards the associated seating due, at least in part, to the innate resilience of the material from which it is made.

13 Claims, 8 Drawing Figures

CLOSURE CAPS FOR VESSELS

Figure 1:
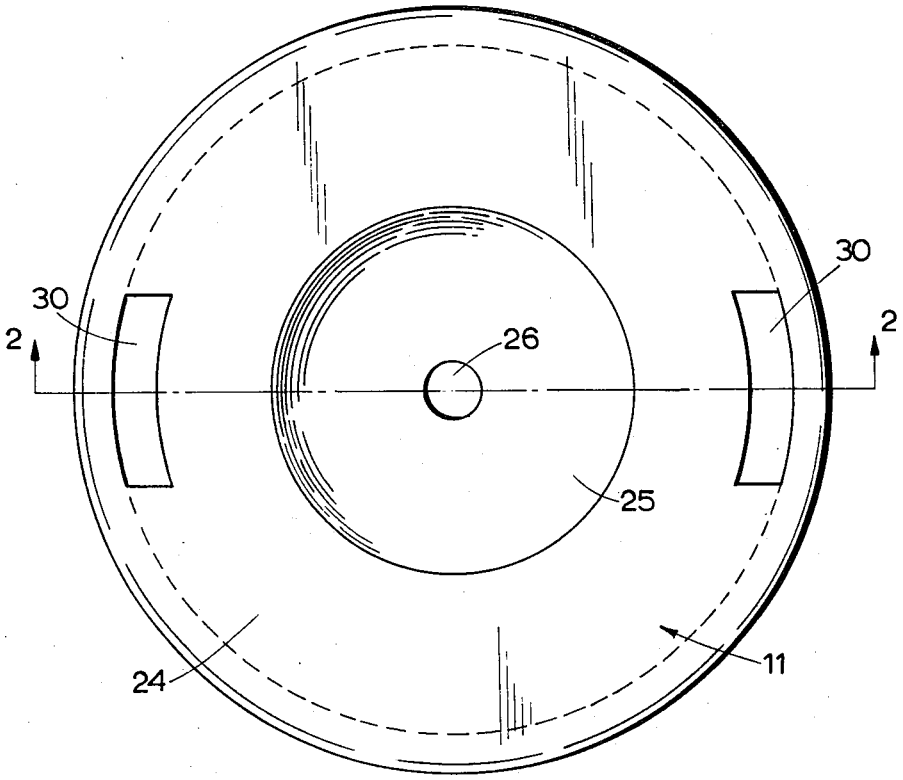

This invention relates to closure caps for insertion into openings in vessels.

A known type of closure cap comprises a body with attachment means operative to enable the cap to be releasably secured in the opening to be closed by the cap, an inner seal on the body for engagement with an inner seating around the opening, and an outer seal on the body for engagement with an outer seating around the opening.

This known type of closure cap thus provides two seals: an inner seal and an outer seal, and those seals act in series so that fluid escaping from the vessel past the inner seal must then pass the outer seal before it can pass through the opening. Such a closure cap may serve merely to provide double security or it may serve other purposes. For example the arrangement may be such that there is an escape duct leading from a part of the opening between the inner and outer seatings so that fluid passing the inner seal can then pass through the escape duct while still being prevented by the outer seal from passing through the opening. Further the arrangement may be such that if the pressure in the vessel rises above a predetermined value, which will hereinafter be referred to as the relief pressure, the inner seal will yield to allow fluid to escape from the vessel, past the inner seal and thence to the escape duct. Arrangements of that kind are commonly employed in radiators and radiator caps, that is the caps used for closing the water inlet of the radiator of an automobile engine.

As will become apparent, the present invention aims among other things to provide improved forms of radiator cap.

In the past radiator caps and other closure caps of the known kind referred to above have usually been made from a relatively large number of components, many of which are of metal. Such caps have therefore been relatively costly and have been liable to deteriorate due to rust and corrosion. The main aim of the present invention is to provide a closure cap of the kind described and such that those disadvantages are overcome or are at least reduced.

According to the present invention there is provided a closure cap for insertion into an opening in a vessel, comprising a body with attachment means operative to enable the cap to be releasably secured in the opening, an inner seal on the body for engagement with an inner seating around the opening, and an outer seal on the body for engagement with an outer seating around the opening, characterised in that at least one of said seals comprises an outwardly directed flange of a flexible and resilient plastics material supported by the body at its inner edge and capable of yielding resiliently when it engages its associated seating so that the flange is urged towards the seating due at least in part to the innate resilience of the material.

One only of the seals may comprise a flange of the kind described above, or both seals may comprise flanges of that kind. In use, during the final stages of insertion of the cap into the opening the flange-seal, or each of the flange-seals, engages the associates seating and then flexes resiliently so that when the cap has been fully inserted the flange is resiliently deformed and its innate resilience urges it towards the seating. The flange may engage the seating directly, or a sealing material may be interposed between the flange and the seating.

For example the sealing material may comprise a layer of relatively soft material applied to the flange or it may comprise a disc or washer of such material disposed against the flange.

Although the innate resilience of the flange may be sufficient to cause the flange to exert an adequate sealing force to ensure a satisfactory seal, spring means may be provided to assist in urging the flange-seal into engagement with the associated seating when the cap is in use. The spring means may conveniently comprise a helical compression spring.

The body of the closure cap may be of composite form.

In a preferred construction of cap both seals comprise flanges of the kind outlined above, and the flanges are formed integrally with a common support, the flanges and support together constituting at least part of a sealing component, while the support constitutes part of said body. The sealing component may additionally include sealing material as described above. The attachment means may then form part of an attachment component separately formed from the sealing component. Like the sealing component the attachment component preferably comprises a moulding of a plastics material. The attachment means may be of a conventional kind and such as to be engageable and releasable by rotational movement of the attachment component, and the attachment component is then preferably rotatable relatively to the sealing component. With this arrangement the attachment can be rotated to engage or disengage the attachment means while the parts of the cap engaging the seatings remain without rotation. The attachment and sealing components are preferably in snap-engagement with each other so as to permit the desired relative rotation.

In a preferred construction the sealing component has an axial hole into which projects a spigot on the attachment component, one of the two being formed with a circular groove, and the other with a circular rib or a ring of projections for snap engagement in the groove when the components are assembled.

The novel closure cap thus far described operates to enable excess pressure in a vessel to be released. It sometimes happens, however, as for example in automobile radiators, that the pressure in the vessel falls below atmospheric pressure. In such circumstances it is necessary, or at least highly desirable, to provide means whereby air (or other gas) from outside the vessel can pass into the vessel until the pressure inside equals or approaches that obtaining outside the vessel.

It is therefore preferred to provide a valve in the closure cap which opens when the pressure inside the vessel falls significantly below that of the surrounding atmosphere that is to a pressure which will hereinafter be referred to as the suction pressure, but closes when the pressure inside the vessel rises above the suction pressure.

In a preferred construction the closure cap is formed with a duct leading from a space inwardly of the inner seal and communicating with a space outwards of at least the inner seal, and there is a valve provided to close the duct and comprising a valve member operable in use in response to a pressure differential across the valve, the higher pressure being in the duct.

The duct may lead directly from the interior of the vessel to the surrounding atmosphere. In a preferred arrangement, however, the duct leads to a space between the seals so that in use fluid is drawn by suction into the vessel from a location between the two seals. The vessel may include an opening or passage linking the space between the two seatings with the atmosphere or with some other container. In such constructions the duct may extend through the sealing component and the attachment component. Where the arrangement is such that relative rotation can occur between the sealing and attachment components the arrangement is made such that apertures in the spigot and in the body, constituting portions of the duct remain in communication in all relative rotational positions of the components. For example the spigot may be formed with a blind axial hole, the valve seating being formed at the open end thereof, and an axially elongate slot constituting part of the duct may be formed in the side of the spigot so as to communicate with the blind axial hole, a portion of the slot always being aligned with a portion of one of a plurality of circumferentially extending arcuate slots formed in the body of the sealing component and constituting the remainder of the duct, the ends of the arcuate slots overlapping so that a portion of at least one arcuate slot registers with a portion of the slot in the spigot whatever the relative rotational positions of the sealing and attachment components may be.

In an alternative arrangement the components are so shaped that there is an annular gap between them, and there are radially extending holes in the components, those holes constituting portions of the duct. There is thus no need for the holes to be aligned, for whatever the relative rotational positions of the components may be fluid (i.e., gas or liquid) can pass through the hole in the outer component into the annular gap, and thence through the hole in the inner component and through the open valve into the interior of the vessel. Each component is preferably formed with a plurality of holes so as to reduce likelihood of the system failing due to obstruction of the duct.

Figure 2:
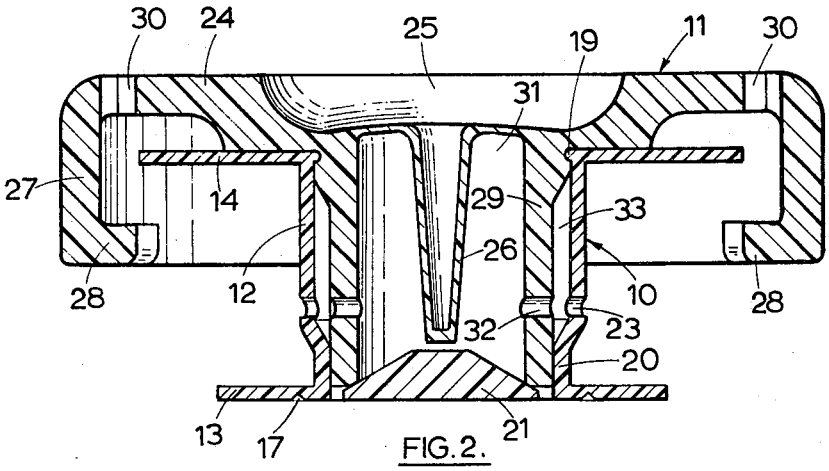
Figure 3:
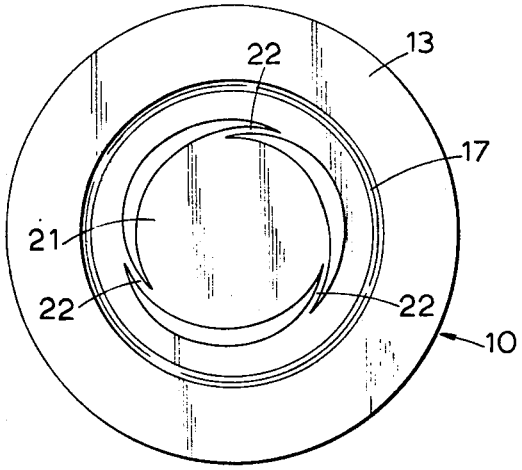
Figure 4:
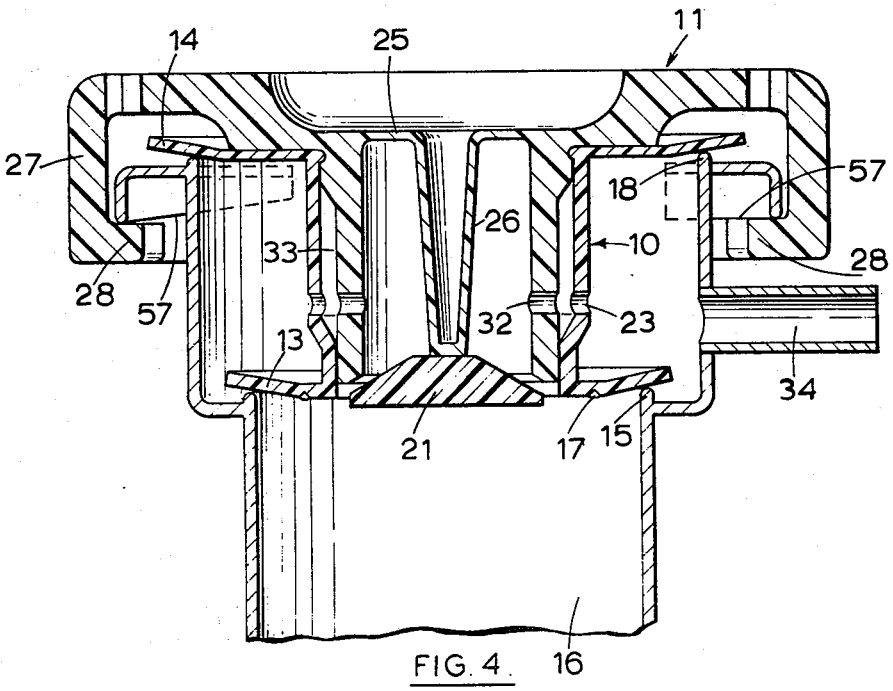
Figure 5:
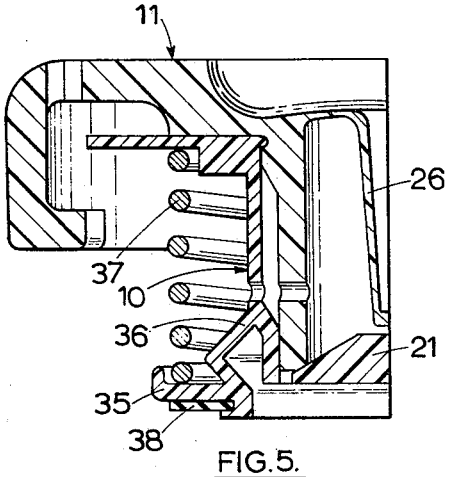
Figure 6:
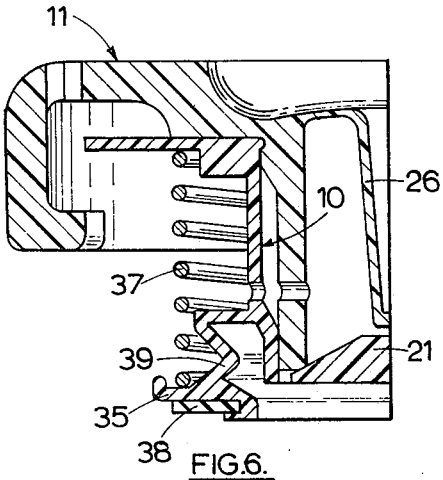
Figure 7:
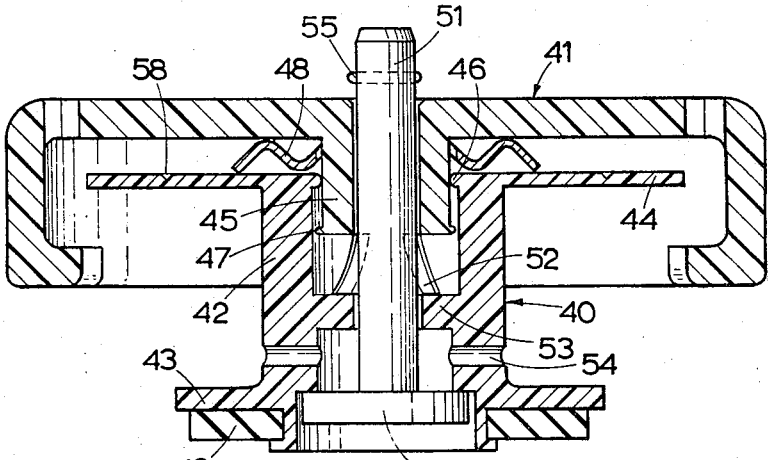
Figure 8:
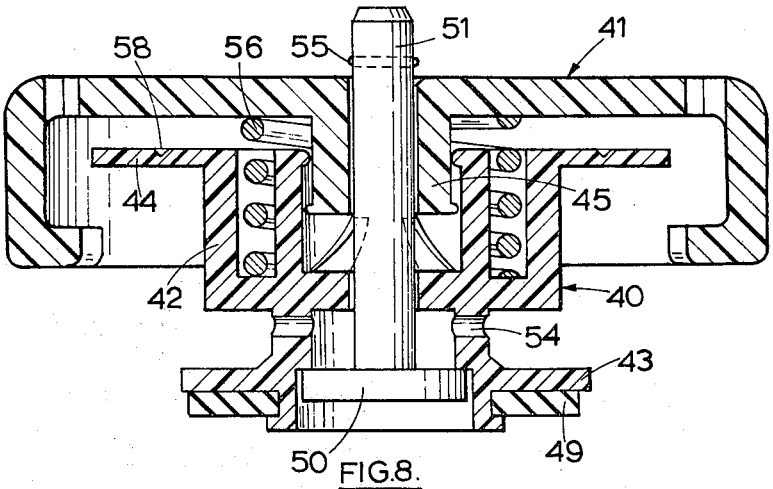

Embodiments of the present invention will now be described in more detail, by way of examples only, with reference to the accompanying drawings in which:

FIG. 1 is a plan view of a closure cap embodying the present invention and intended for use as a radiator cap, FIG. 2 is a section along the line 2—2 of FIG. 1, FIG. 3 is a view of the base only of the cap as seen from below, FIG. 4 is a section similar to FIG. 2 but showing the cap installed on a radiator outlet and showing the pressure-relief valve open, FIG. 5 is a section similar to FIG. 2 but illustrating a modification, and with the right-hand half omitted as it is a mirror-image of the left-hand half, FIG. 6 is a section similar to FIG. 5 but illustrating a further modification, FIG. 7 is a section similar to FIG. 2 but illustrating a rather different form of cap, and FIG. 8 is a section similar to FIG. 7 but illustrating a modification.

The radiator cap illustrated in FIGS. 1 to 4 comprises two components, a sealing component 10 and an attachment component 11. Each is formed as a unitary moulding of a plastics material. The sealing component is made from a plastics material that is flexible and resilient, and properties of which do not vary very greatly within the range of temperatures likely to be encountered in use. Suitable materials for the sealing component are the acetal resins sold under the Registered Trade Marks "Celcon" and "Delrin," and glass-filled materials such as glass-filled nylon. The attachment component 11 may be made from a more rigid material such as polypropylene filled with up to 40% asbestos.

The sealing component 10 comprises a support 12 of tubular shape, with integral outwardly directed flanges 13 and 14 at its ends. The flange 13 constitutes the inner seal, and in use (as shown in FIG. 4) its under surface engages an inner seating 15 of annular shape formed around a filler opening 16 at the top of an automobile radiator. The flange 13 is slightly distorted upwards, and the innate resilience of the flange urges the flange back towards the shape illustrated in FIG. 2 and thus provides the desired sealing force. A groove 17 in the under surface of the flange 13 causes the flange to flex principally in the neighbourhood of that groove. By varying the depth of the groove the sealing force exerted by the flange can be varied as desired. The flange 14 constitutes the outer seal, and in use (as shown in FIG. 4) its under surface engages an outer seating 18 of annular shape also formed around the opening 16 and of sufficient diameter to allow the inner flange 13 to pass through it freely. In use the flange 14 is distorted in a manner similar to the flange 13, but there is no groove in the flange 14, and its upper surface is partially supported as described below, so that it exerts a sealing force greater than that exerted by the inner seal 13.

An annular rib 19 is formed inside the support 12 at the upper end thereof, the rib enabling the two components 10 and 11 to be snapped together into mutual engagement while permitting relative rotation between them. Towards its lower end, the diameter of the support is reduced as indicated at 20, the wall thickness remaining unaltered. A valve member 21 formed integrally with the sealing component 10 is disposed at the lower end of the support 12. The valve member 21 is in the shape of a frustum of a cone, the under surface being planar and the upper surface being largely conical. The valve member 21 is connected to the support 12 by three integral links 22 (see FIG. 3) to enable the valve member to move downwards to an open position as shown in FIG. 4. Each link 22 extends from the valve member 21 in an approximately tangential direction, its outer end joining the lower end of the support 12 at a position which is not radially opposite the inner end, but is offset in a circumferential direction. Each link is curved as viewed in plan, while remaining in a horizontal plane. Thus, when the valve member 21 moves downwards, in opening, it rotates slightly as the links move from the horizontal and approach positions in which they lie in radial planes containing the axis of the valve member.

Radial holes 23 are formed in the wall of the support 12 above the level of the portion 16 of reduced diameter.

The attachment component 11 comprises a round plate 24 of which the central part is formed with a circular depression 25 having at its center a depending tubular rod 26 which is closed at its lower end. A flange 27 depends from the periphery of the plate 24 and is provided with inwardly directed lugs 28. In addition an axial spigot 29 projects downwards from the plate 24. The spigot 29 is of tubular shape and is open at its lower end. It is of considerably larger diameter than the rod 26. The attachment component 11 is formed as a moulding, and to simplify manufacture the upper surfaces of the lugs 28 are defined by mould elements which project through arcuate apertures 30 in the plate 24, those mould elements being fixed to another mould element which defines the upper surface of the plate. In the embodiment illustrated there are two diametrically opposed lugs 28, but it must be understood that there may be more lugs, the number being governed by the number and shape of the complementary attachment formations around the radiator filler opening. An annular groove is formed in the outer surface of the spigot 29 immediately beneath the plate 24, the groove receiving the rib 19 on the sealing component 10 in snap engagement as described above. The spigot is hollow and defines a chamber 31 which is permanently closed at the top, and into which the rod 26 projects. The wall-thickness of the spigot 29 is reduced somewhat, a little below the level of the groove, so that the outer surface of the spigot is not wholly cylindrical but is formed with a step near the upper end thereof. Radial holes 32 are formed in the wall of the spigot at a position below the step but above the level of the portion 20 of the support 12 that is of reduced diameter.

The two moulded components 10 and 11 are assembled by the insertion of the spigot 29 into the support 12 until the rib 19 snaps into the groove in the spigot. It will be observed that the diameter of the outer seal 14 is such that it can just pass the lugs 28 during assembly. It will also be observed that the inner part of the flange 14 constituting the outer seal abuts part of the plate 24 so that some restraint is afforded to the free upward flexure of the flange. This arrangement helps to increase the sealing force exerted by the flange, as mentioned above.

When the components 10 and 11 have been assembled, as illustrated, they can be rotated relatively to each other but the arrangement is such that in use there is no significant leakage of air, gas or vapour either between the reduced portion 20 and the lower end part of the spigot 29, or between the upper part of the support 12 and the thicker, upper portion of the spigot. The valve member 21 seals against the lower end of the spigot 29, the arrangement being such that the links 22 are slightly deformed and therefore exert a continuous force on the valve member tending to urge it into engagement with the valve seat afforded by the lower end of the spigot. When the valve member 21 is in its open position air can pass through it from the outside of the cap, the air passing through a duct constituted by the holes 23 in the support 12, the annular gap 33 between the central portions of the support 12 and spigot 29, the radial hole 32 in the spigot, and the chamber 31 in the spigot. The duct remains open, of course, irrespective of the relative rotational positions of the sealing component 10 and the attachment component 11.

In use the cap is pressed into position, the inner and outer seals 13 and 14 being resiliently deformed as described above on engagement with the inner and outer seatings 15 and 18 respectively. The attachment component 11 is then rotated, thus bringing the lugs 28 into engagement with cam surfaces 57 provided around the outside of the radiator filler opening in the usual manner, as shown in FIG. 4. The cam surfaces are normally of part-helical shape and terminate in flat portions or locking notches.

When the pressure in the radiator exceeds a certain value the inner seal 13 lifts from its seating and allows steam or water vapor to escape into that part of the radiator inlet opening between the two seatings. An overflow duct 34 leads from that part, so the steam or vapor can pass to the atmosphere by way of that duct. The outer seal 14 does not open in response to that pressure so that there is no escape of the steam or hot vapor to the atmosphere in the immediate neighborhood of the cap itself. Further, the pressure differential between the inside of the radiator and the atmosphere also assists in maintaining the valve member 21 in its closed position. If the engine is subsequently switched off and the radiator cools, the pressure in the radiator may fall below atmospheric pressure in which event the valve member 21 moves to its open position and allows air to enter the radiator by way of the ducts referred to above.

If the cap is to be removed while there is still excess pressure in the radiator the user can depress the flexible central part of the plate 24, at the bottom of the depression 25, and thus cause the rod 26 to engage the valve member 21 and open the valve. Fluid can then escape through the ducts described until the pressure in the radiator is reduced to atmospheric pressure. In a modification (not illustrated) the central part of the plate 24 is shaped to project upwards, above the level of the remainder of the plate, so that a user grasping the cap to remove it will automatically depress the raised central part with his palm and thus cause the valve member to open.

Numerous modifications may of course be made without departing from the scope of the present invention. For example the radial holes 23 and 32 may be omitted and replaced by a single axial hole extending through the plate 24, to one side of the rod 26 so as to communicate with the chamber 31.

If insufficient sealing force is exerted by the inner flange 13, or if there is a tendency for that flange to "set" and after prolonged distortion to acquire a shape approximating to that shown in FIG. 4, a metallic spring may be added to urge the flange downwards. In a preferred arrangement the spring is a helical compression spring co-axial with the cap and acting between the upper surface of the flange 13 and the lower surface of the flange 14.

In a modification of that arrangement, illustrated in FIG. 5 the inner flange 13 is omitted and is replaced by a flange 35 supported from the support 12 by an integral portion 36 shaped as a short length of cylindrical bellows and capable of yielding resiliently to allow the up-and-down movement of the flange. A helical compression spring 37 acts between the flange 35 and the flange 14. A sealing ring 38 of rubber or rubber-like material is mounted on the underside of the flange to seal against the lower seating. The spring 37 is like the spring that could be used to assist the flange 13 as described in the last preceding paragraph.

FIG. 6 illustrates a further slight modification, the flange 35 being joined to the support 12 by an integral bellows-like portion 39 of a shape different from the portion 36.

FIG. 7 illustrates a radiator cap similar in some ways to those described above, but incorporating a number of significant differences. The cap comprises a sealing component 40 and an attachment component 41. The sealing component has a cylindrical support 42 with integral inner and outer flanges 43 and 44 respectively. Instead of being connected together in such a manner as to prevent their relative axial movement, however, the components are connected so as to be capable of relative axial movement. To this end a tubular spigot 45 on the attachment component enters the support 42, the two being prevented from inadvertent disassembly by the provision of integral beads 46 and 47 at the top of the support 42 and the bottom of the spigot 45 respectively. A spring 48 in the form of a disc with annular corrugations acts between the two components. A sealing ring 49 is mounted on the underside of the inner flange 43.

In use the spring 48 urges the sealing component 40 downwards relatively to the attachment component 41 and the two flanges 43 and 44 flex resiliently when they engage their respective seatings. The inner flange 43 may flex scarcely at all, while the outer flange 44 flexes to a much more noticeable extent. An annular groove 58 in the outer flange determines the extent to which the flange flexes.

A valve member 50 on a stem 51 seats against a valve seating formed at the lower end of the support 42. Spring arms 52 integral with the stem 51 engage an inwardly directed integral flange 53 in the bore of the support 42 and urge the valve member into engagement with the valve seating. The upper end of the stem 51 projects at the top of the cap. When the cap is to be opened the user's palm depresses the projecting end of the stem and thus causes the valve to open permitting excess pressure to be relieved by way of the open valve and holes 54 in the support 42. An annular bead or ring 55 around the stem 51 limits the downward movement of the valve.

In the modified construction illustrated in FIG. 8 the spring 48 is replaced by a helical compression spring 56 that acts between the attachment component 41 and the base of a relatively deep annular groove formed in the support 42.

I claim:

1. A closure cap for insertion into an opening in a vessel, comprising an attachment component with attachment means operative to enable the cap to be releasably secured in the opening and a sealing component separately formed from the attachment component, said sealing component being of a flexible and resilient plastics material formed as a unitary whole and comprising a support and including an inner seal integral with said support for engagement with an inner seating around the opening and an outer seal integral with said support for engagement with an outer seating around the opening, at least one of said seals comprising an outwardly directed flange integrally supported at its inner edge by the support and capable of yielding resiliently when it engages its associated seating so that the flange is urged towards the seating due at least in part to the innate resilience of the material, said closure cap having a duct leading from a space inwardly of the inner seal and communicating with a space outward of at least the inner seal, and a valve for closing the duct and comprising a valve member integral with the sealing component and openable in use in response to a pressure differential across the valve, the higher pressure being in the duct.

2. A closure cap according to claim 1 in which there is an area of reduced thickness adjacent to the inner edge of said flange where the main flexure of the flange occurs in use.

3. A closure cap according to claim 1 in which said flange is provided with sealing material for engaging the associated seating.

4. A closure cap according to claim 1 in which the attachment means is such as to be engageable and releasable by rotational movement of the attachment component, and in which the attachment component is rotatable relatively to the sealing component.

5. A closure cap according to claim 4 in which the sealing component has an axial hole into which projects a spigot on the attachment component, one of the two being formed with a circular groove and the other with at least one projection for snap-engagement in the groove while permitting relative rotation between the components.

6. A closure cap according to calim 1 in which the attachment component is in snap-engagement with the sealing component.

7. A closure cap according to claim 6 in which the valve member is connected to the remainder of the sealing component by a plurality of flexible and resilient links spaced around the valve member and constituting integral parts of the sealing component, the links being operative to hold the valve member in its closed position but to yield in response to said pressure differential so as to permit the valve member to move to its open position.

8. A closure cap according to claim 7 in which there is a valve seat formed on the attachment component and engaged by the valve member when the valve is closed.

9. A closure cap according to claim 8 in which the duct extends from the valve, through at least one opening in the attachment component, through an annular gap between the attachment component and the support and through at least one opening in the support issuing between the inner and outer seals.

10. A closure cap according to claim 7 in which the valve is manually operable from outside the cap.

11. A closure cap according to claim 10 in which the sealing component is tubular and a valve-operating member entends lengthwise of the sealing component and can be manipulated to open the valve, the valve-operating member is formed separately from the attachment component and projects through an aperture in the attachment component, and the valve-operating member is formed with integral spring means operative to urge the valve member to its closed position.

12. A closure cap according to claim 10 in which there is spring means operative to assist the inner seal.

13. A closure cap according to claim 1 in combination with a vessel having an opening, an inner seating and an outer seating around that opening and attachment formations operative for releasable engagement by the attachment means.

* * * * *